US005657692A

United States Patent [19]

Theriault et al.

[11] Patent Number: 5,657,692

[45] Date of Patent: Aug. 19, 1997

[54] REMOVABLE SUPPLY AND UPTAKE ASSEMBLIES FOR LITHOGRAPHIC PLATE MATERIAL

[75] Inventors: Edwin G. Theriault, Hudson, N.H.; James R. Moss, Satellite Beach, Fla.; John P. Gardiner, Londonderry; Douglas D. Fuller, Contoocook, both of N.H.

[73] Assignee: Presstek, Inc., Hudson, N.H.

[21] Appl. No.: 435,094

[22] Filed: May 4, 1995

[51] Int. Cl.[6] ..... B41J 7/20

[52] U.S. Cl. ..... 101/141; 101/132; 101/477

[58] Field of Search ..... 101/141, 142, 101/132, 136, 212, 216, 415.1, 477; 242/67.3 R; 355/213

[56] References Cited

U.S. PATENT DOCUMENTS

| | | | |
|---|---|---|---|
| 866,624 | 9/1907 | Collier | 101/46 |
| 3,491,684 | 1/1970 | Borinsky | 101/132 |
| 3,600,086 | 8/1971 | Cates et al. | 101/132 |
| 3,821,931 | 7/1974 | Yamaji et al. | 101/132 |
| 3,826,570 | 7/1974 | Kolibas | 101/132 |
| 3,926,515 | 12/1975 | Nagahara | 355/213 |
| 4,076,183 | 2/1978 | Kingsley | 242/67.3 R |
| 4,076,410 | 2/1978 | Kono et al. | 242/67.3 R |
| 4,097,183 | 6/1978 | Kingsley . | |
| 4,102,570 | 7/1978 | Shimoda | 355/16 |
| 4,231,652 | 11/1980 | Moser et al. . | |
| 4,239,375 | 12/1980 | Eisbein et al. | 355/16 |
| 4,400,083 | 8/1983 | Beisty et al. | 355/211 |
| 4,477,180 | 10/1984 | Bustamante | 355/208 |
| 4,575,890 | 3/1986 | Hidle | 15/104.002 |
| 4,769,652 | 9/1988 | Cleary et al. | 346/136 |
| 4,919,047 | 4/1990 | Inouye et al. | 101/175 |
| 4,936,211 | 6/1990 | Pensavecchia et al. | 101/136 |
| 5,163,368 | 11/1992 | Pensavecchia et al. | 101/467 |
| 5,355,795 | 10/1994 | Moss et al. | 101/141 |
| 5,413,043 | 5/1995 | Fuhrmann et al. | 101/415.1 |
| 5,435,242 | 7/1995 | Kusch et al. | 101/415.1 |

FOREIGN PATENT DOCUMENTS

| | | |
|---|---|---|
| 4303872 | 10/1993 | Germany . |
| 683132 | 11/1952 | United Kingdom . |

*Primary Examiner*—Ren Yan

*Attorney, Agent, or Firm*—Cesari and McKenna, LLP

[57] ABSTRACT

A system for accepting and winding lithographic plate material around a cylinder adapted for rotation about a longitudinal axis includes supply and uptake spools and an alignment tool for use therewith. The cylinder is hollow, having an interior and an axial opening thereto, and includes means within its interior for selectably engaging supply and uptake spools. The engagement means are in fixed alignment with one another and are disposed within the cylinder so as to define an unobstructed winding path extending around the cylinder from the supply spool to the uptake spool. Plate material stored on the supply spool is extended around this path and affixed to the uptake spool. The tool includes means for releasably gripping supply and uptake spools, and alignment components for aligning the gripping means to at least one engagement means within the cylinder when the tool is introduced therein. The tool is removed from the cylinder following release of the spools to the engagement means.

11 Claims, 8 Drawing Sheets

REMOVABLE SUPPLY AND UPTAKE ASSEMBLIES FOR LITHOGRAPHIC PLATE MATERIAL

BACKGROUND OF THE INVENTION

1. Field of the Invention

The present invention relates generally to planographic printing, and in particular to an apparatus for continuously supplying new plate material to the plate cylinder of planographic printing press or plate-imaging apparatus.

2. Description of the Related Art

U.S. Pat. No. 5,355,795 (the entire disclosure of which is hereby incorporated by reference) describes a system providing for the continuous provision of blank lithographic plate material around a plate cylinder for automated imaging and subsequent printing therewith. In the disclosed system, a feeder spool installed within the cylinder contains a rolled supply of plate material, which wraps around the cylinder and is received by an uptake spool, also located within the cylinder. The assembly maintains a strong tension along the wrapped material, and is driven by the same power source used to rotate the plate cylinder; upon actuation by a user the system couples rotary power to the spools, drawing fresh plate material from the supply spool and advancing used plate material then surrounding the cylinder to the uptake spool.

The '795 patent envisions installation of the supply and uptake spools within a cassette frame that is inserted into the cylinder body and is withdrawn when all plate material has been used. This arrangement ensures that the spools, when introduced into the cylinder, will be precisely aligned with complementary components of the plate-advancing system; obviously, substantially perfect alignment is required for proper cooperation among the components.

The cassette arrangement, however, has certain limitations. Chief among these are cost and weight. The relatively heavy frame construction of the cassette, when disposed within the cylinder, demands additional rotary power to turn the complete assembly. More importantly, the extra weight can cause an out-of-balance condition unless all components are carefully arranged within the cylinder, imposing stringent spatial relationships among the interior cylinder components and limiting design options. The cost associated with the cassette frame is multiplied not only by the number of print stations on a press utilizing the plate-advancing system, but also by the typical need to maintain at least one pre-loaded cassette outside the press for each such cylinder in order to avoid idle press time.

DESCRIPTION OF THE INVENTION

BRIEF SUMMARY OF THE INVENTION

The present invention eliminates entirely the need for a cassette-type structure, reducing the removable items introduced into the cylinder to a feeder spool containing a supply of fresh plate material (as described, for example, in any of U.S. Pat. Nos. 4,911,075; 5,106,695; 5,165,345; 5,339,737; 5,353,705; and/or 5,379,698), and an uptake spool for accepting spent plate material. The plate material wraps around the cylinder and is received by the uptake spool. Both spools—which have similar or like configurations and may be used interchangeably (with adapters, if necessary)—are precisely positioned for engagement to appropriate components within a cylinder using an alignment tool.

Examples of suitable press environments for the present invention are disclosed in the '795 patent. These include in-line presses, central-impression presses, and virtually any type of printing arrangement that utilizes automated plate-imaging equipment. Although the invention is well-suited to automated apparatus that image lithographic printing plates without chemical processing, it can also be used with plate material designed to undergo traditional forms of processing. Furthermore, the invention may also be utilized (although with less advantage) in imaging systems that operate off-press.

In one aspect, the invention comprises a tool for loading lithographic plate material into a hollow cylinder having an interior, an axial opening thereto and, within the cylinder, means for selectably engaging supply and uptake spools to the cylinder. The tool includes means for releasably gripping supply and uptake spools, and alignment components for aligning the gripping means to at least one engagement means within the cylinder when the tool is introduced therein. The tool is removed from the cylinder following release of the spools to the engagement means therein.

More generally, the invention comprises a system for accepting and winding lithographic plate material around a cylinder adapted for rotation about a longitudinal axis. The cylinder is hollow, having an interior and an axial opening thereto, and includes means within its interior for selectably engaging supply and uptake spools. The engagement means are in fixed alignment with one another and are disposed within the cylinder so as to define an unobstructed winding path extending around the cylinder from the supply spool to the uptake spool. Plate material stored on the supply spool is extended around this path and affixed to the uptake spool. The system also includes means for rotating the cylinder and means for selectably coupling rotary power to the spools so as to advance material from the supply spool to the uptake spool via the winding path.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
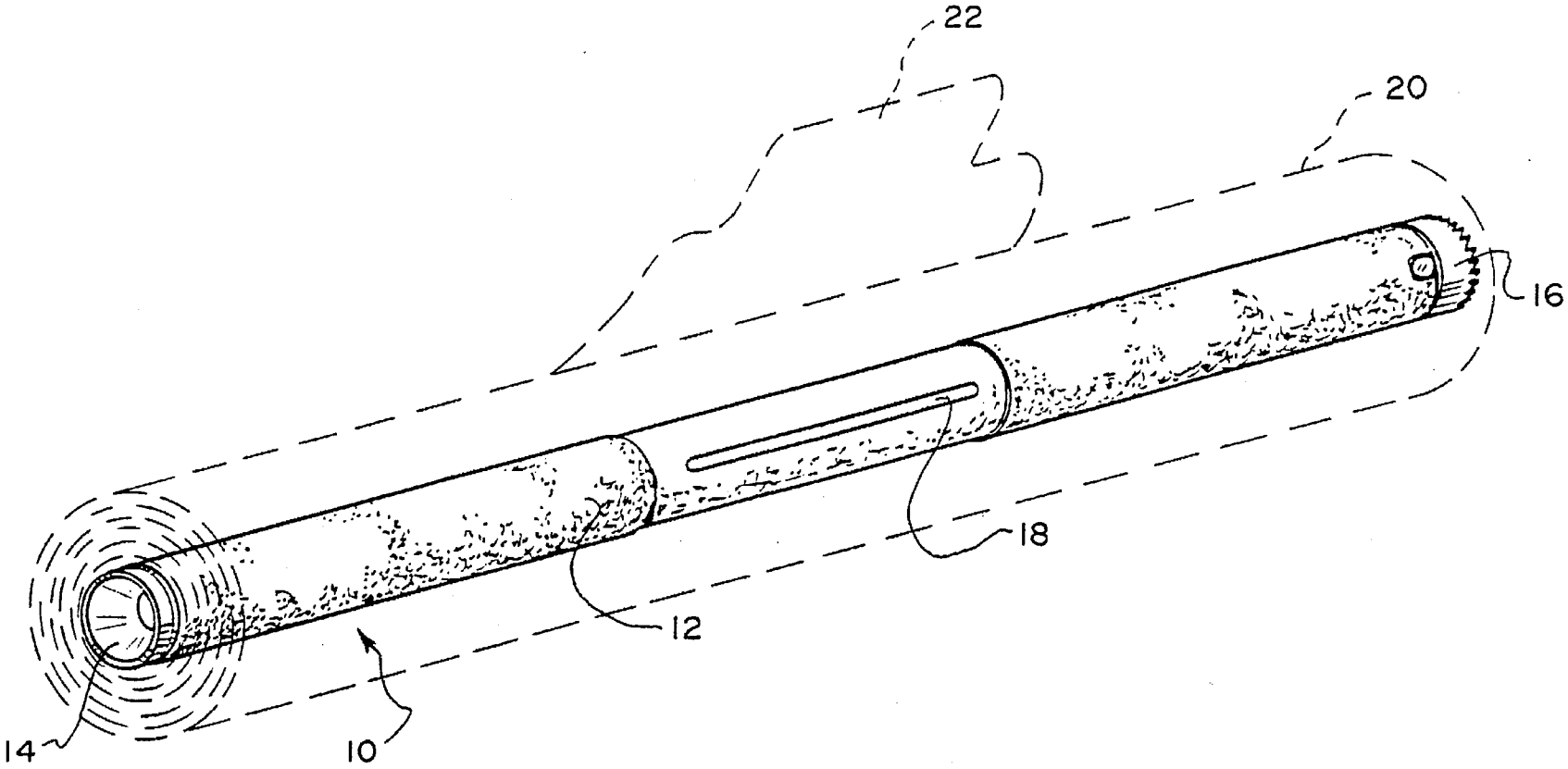
FIG. 1 is an isometric view of a supply or uptake spool utilized as a supply spool, with lithographic plate material shown in phantom.

Refer first to FIG. 1, which illustrates a spool design in accordance with the present invention that may be used for uptake or supply of plate material. The spool 10 comprises a hollow, elongated, cylindrical roller 12 that includes a concave engagement member 14 at one end and a toothed engagement gear 16 at the opposite end. Engagement member 14 fits tightly within the bore of roller 12 so that the cylinder edge forms a ridge or shoulder around the outer surface of member 14.

Spool 10 is formed of a heavy-duty, dimensionally stable material, such as stainless steel, that can endure the substantial torque and other forces resulting from the printing process without bending, compressing or otherwise changing in shape. Roller 12 includes a longitudinal slot 18, which, when the spool is used for uptake, accepts an edge of the plate material from the supply spool. The spool 10 in FIG. 1 is shown as a supply spool, with a web of plate material 20 (illustrated in phantom) wound therearound. The plate material 20 is formed into a tab 22 at the free end thereof. Tab 22 fits within slot 18, thereby facilitating engagement of plate material to an uptake spool. The outer surface of roller 12 is preferably rough in order to promote retention of the material during uptake, and the plate material itself should be flexible enough to tolerate unrolling and winding; ideally, the material retains a crease formed when tab 22 is inserted into slot 18, further limiting any tendency toward slippage.

Figure 2C:
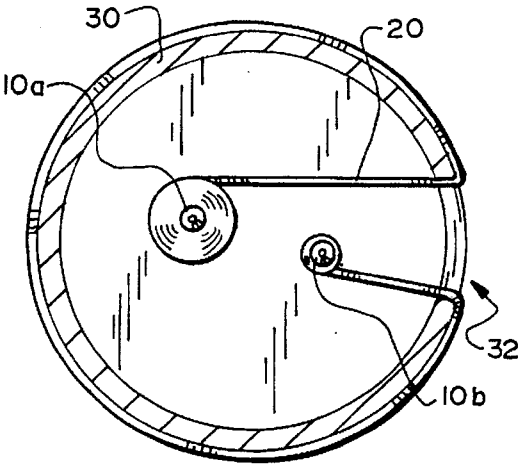
FIGS. 2A–2C are diagrammatic, sectional end views of a plate cylinder containing supply and uptake spools in accordance with the invention.
Figure 2B:
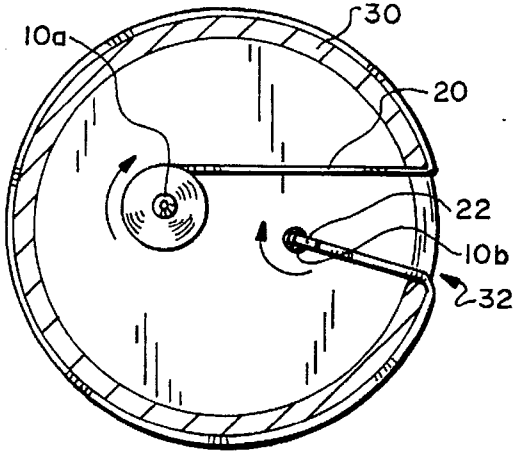
Figure 2A:
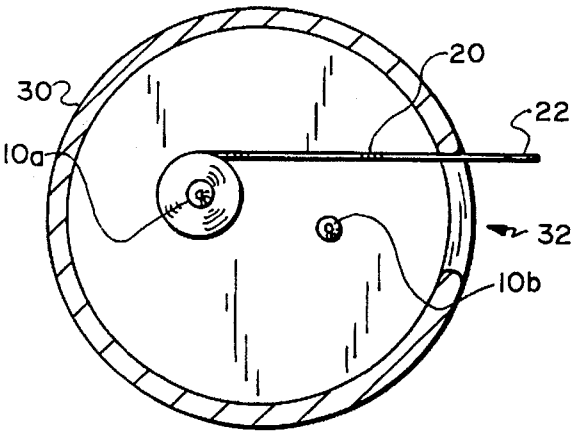

The manner in which plate material 20 is wrapped around a plate cylinder in preparation for imaging and subsequent printing is shown in FIGS. 2A–2C. With a supply spool 10*a* and an uptake spool 10*b* rotatably mounted within a plate cylinder 30 as described hereinbelow, tab 22 is withdrawn through a longitudinal opening (sometimes called a "void segment" or slot) 32 in cylinder 30 that is at least as wide as the plate material, and brought around the outer surface of cylinder 30. Tab 22 is then reintroduced through opening 32 and inserted into the slot 18 of uptake spool 10*b*. As shown in FIG. 2B, uptake spool 10*b* is rotated to wind material onto the spool, withdrawing additional material from supply spool 10*a*, until enough material is wound around spool 10*b* to render slippage therefrom of tab 22 unlikely. When this occurs, the plate material surrounding cylinder 30 is ready to be imaged, and further rotation of spools 10*a*, 10*b* is unnecessary until printing is complete and a new segment of plate material is required.

Figure 3A:
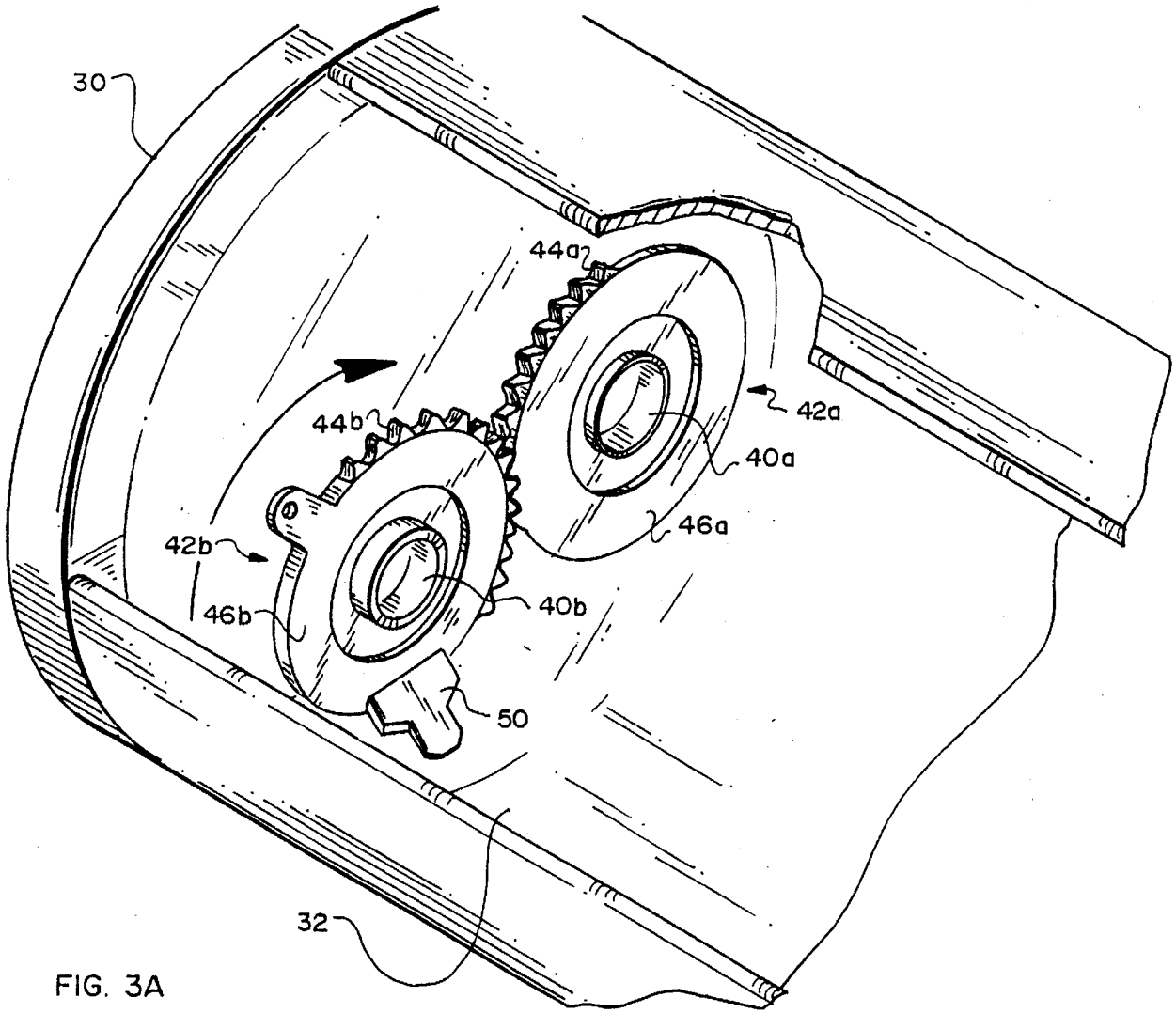
FIGS. 3A and 3B are isometric views of the interior of a plate cylinder showing the components that receive one end of the supply and uptake spools.
Figure 3B:
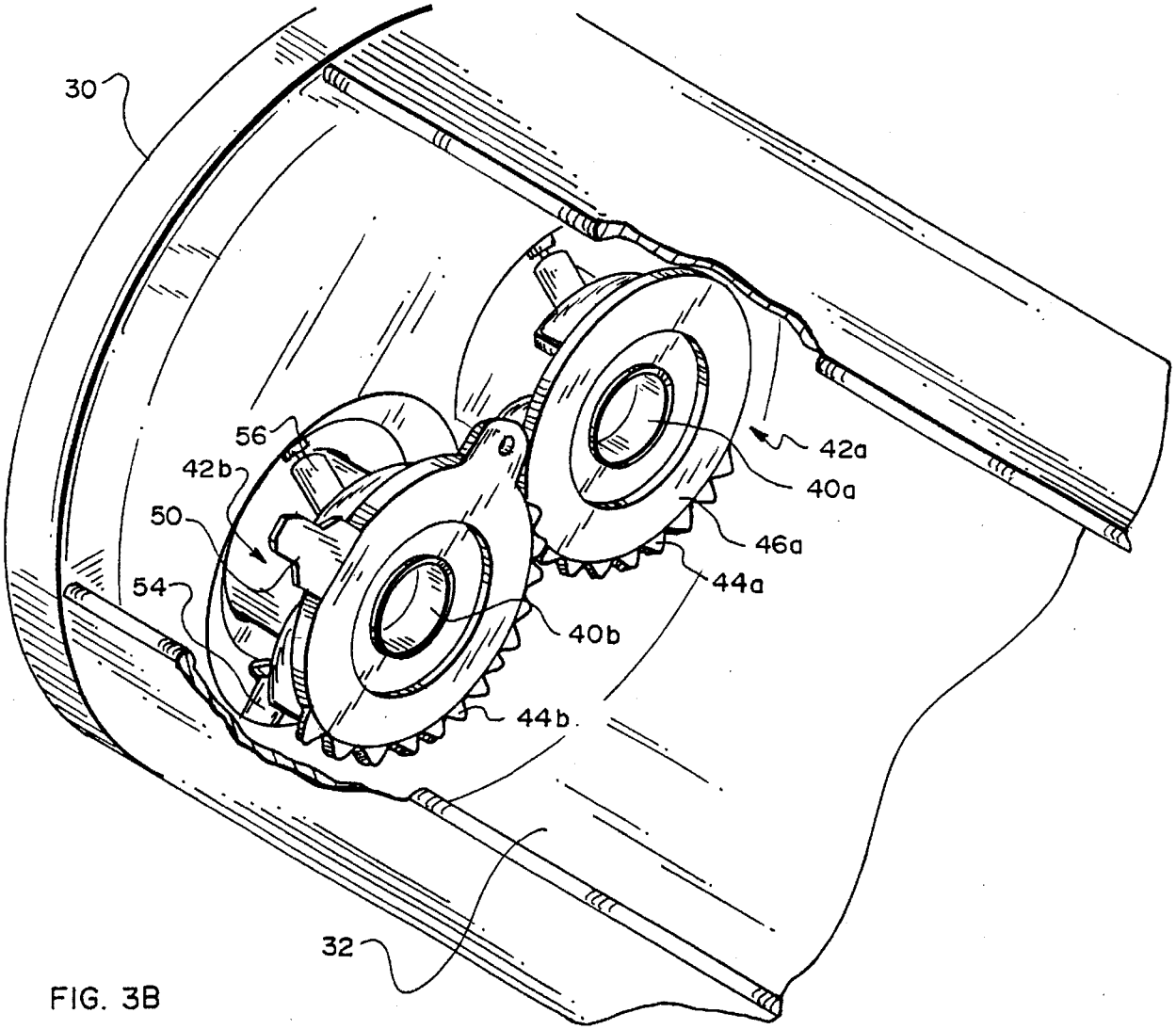

The manner in which the supply and uptake spools are engaged within cylinder cylinder 30 is shown in FIGS. 3A, 3B, 4A and 4B. Refer first to FIGS. 3A and 3B, which illustrate the engagement and retention mechanism itself. A pair of individual sleeve members 40*a*, 40*b*, associated with cylinder 30 as described below, each receive an engagement member 14; in particular, sleeve 40*a* couples to supply spool 10*a* and sleeve 40*b* couples to uptake spool 10*b*. Preferably, the outer diameter of the sleeves substantially matches that of the roller 12 and the inner sleeve diameter matches the outer diameter of engagement member 14; in this way the engagement members fit snugly within sleeves 40*a*, 40*b*, and the rims of the sleeves meet the rims of rollers 12 when engagement members 14 have been fully received within the sleeves. Also, for reasons explained hereinbelow, it is desirable for the diameter of the engagement member 14 to match that of gear 16.

The sleeves 40*a*, 40*b* are each mounted to a camming assembly 42*a*, 42*b*, which is designed for longitudinal movement within cylinder 30. When viewed by a user through opening 32, the assemblies 42*a*, 42*b* are more or less vertically aligned with one another, with assembly 42*a* disposed below assembly 42*b*. The assemblies are geared together by a pair of arcuate toothed segments 44*a*, 44*b* that mesh with one another. The arcuate segments are attached to, or machined into, a pair of face plates 46*a*, 46*b* that surround sleeves 40*a*, 40*b* and define the profile of the camming assemblies. A tab 50, accessible to a user through opening 32, is mounted to face plate 46*b* of camming assembly 42*b*. After positioning the supply and uptake spools as hereinafter described, the user rotates tab 50 as shown in FIG. 3B to translate assemblies 42*a*, 42*b* longitudinally until sleeves 40*a*, 40*b* receive engagement members 14.

Figure 4A:
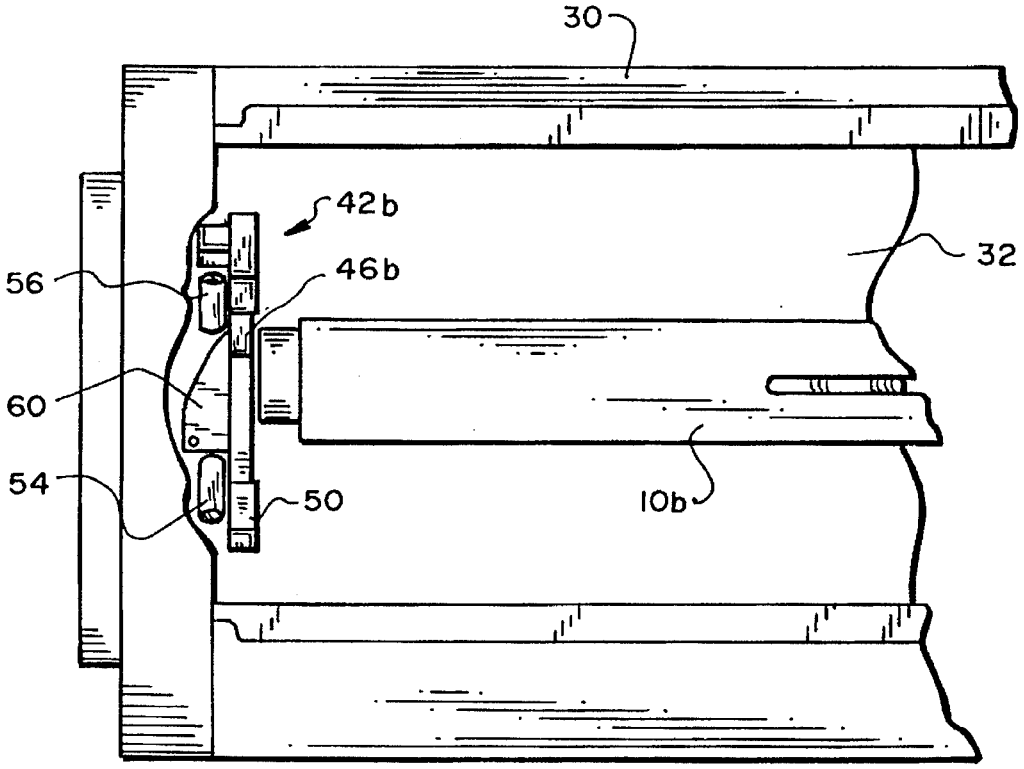
FIGS. 4A and 4B are plan views of the components illustrated in FIGS. 3A and 3B, specifically illustrating the components that facilitate longitudinal translation thereof.
Figure 4B:
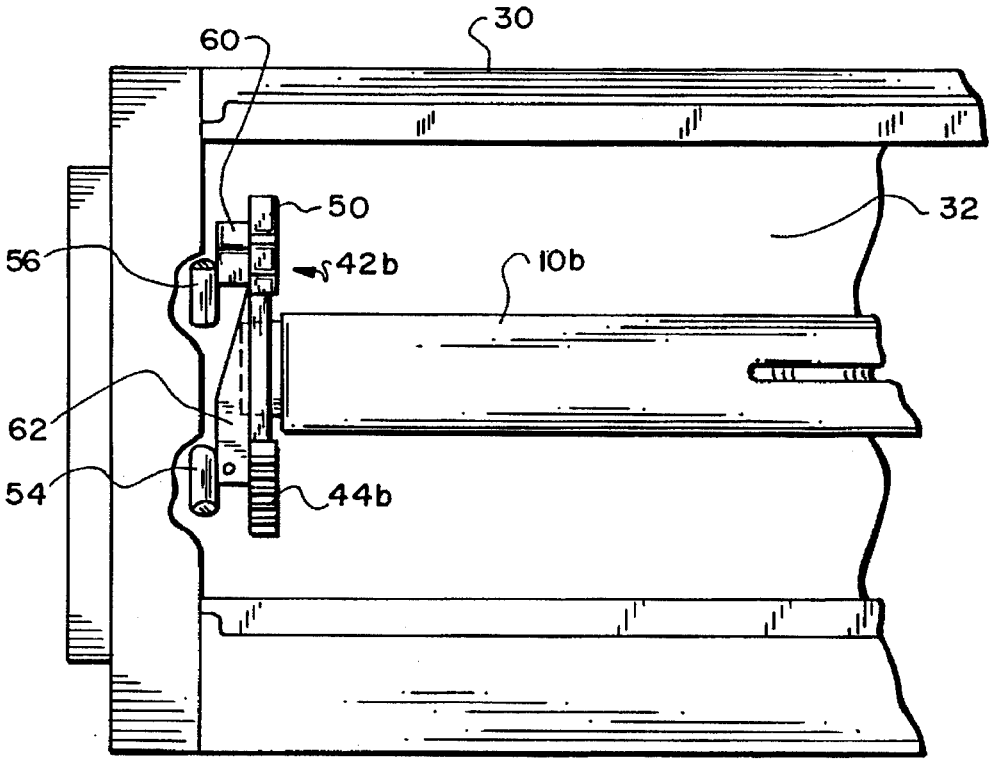

The operative components of the camming assemblies are shown in FIGS. 4A and 4B. Mounted to the cylinder, and behind each face plate 46*a*, 46*b*, is a set of three cam rollers, two of which are shown at 54, 56 (see also FIG. 3B); an identical set of three rollers, associated with assembly 42*a*, is disposed beneath the illustrated rollers. Each cam roller pivots about an individual axis fixed with respect to cylinder 30; these axes are coplanar and oriented at 120° angles to one another, as best shown in FIG. 3B. Mounted to the rear side of each face plate 46*a*, 46*b* is a set of three cams that ride along the cam rollers. In the disengaged position, shown in FIG. 4A, the cams occupy recesses between the rollers; in FIG. 4A, the single visible cam 60 fits between the illustrated rollers 54, 56. Rotation of tab 50 in a clockwise direction across the opening 32 causes the cams to ride along their associated rollers, linearly translating assemblies 42*a*, 42*b*.

This is illustrated in FIG. 4B, which shows the visible assembly 42*b* in the engaged position. The full sloped extent of cam 60 has passed along roller 56, as has that of a cam 62 (not visible in FIG. 4A) along roller 54. And since the camming assemblies are geared together, assembly 42*a*, not visible in FIGS. 4A and 4B, has undergone an identical action. The assemblies 42*a*, 42*b* are secured to cylinder 30 by telescoping shaft arrangements located behind the face plates 46*a*, 46*b*; for clarity, these are omitted from FIGS. 4A and 4B.

On the opposite side of the supply and uptake spools, the gears 16 preferably couple the spools to the drive and braking mechanism disclosed in the '795 patent. Specifically, the gears 16 function as do the toothed couplings 150*a*, 150*b* in the '795 patent, connecting the supply and uptake spools to ratchet 66 and uptake gear 115 by means of complementary gears affixed thereto. The gears mesh when the camming assemblies have fully received the engagement members of the spools.

Figure 5:
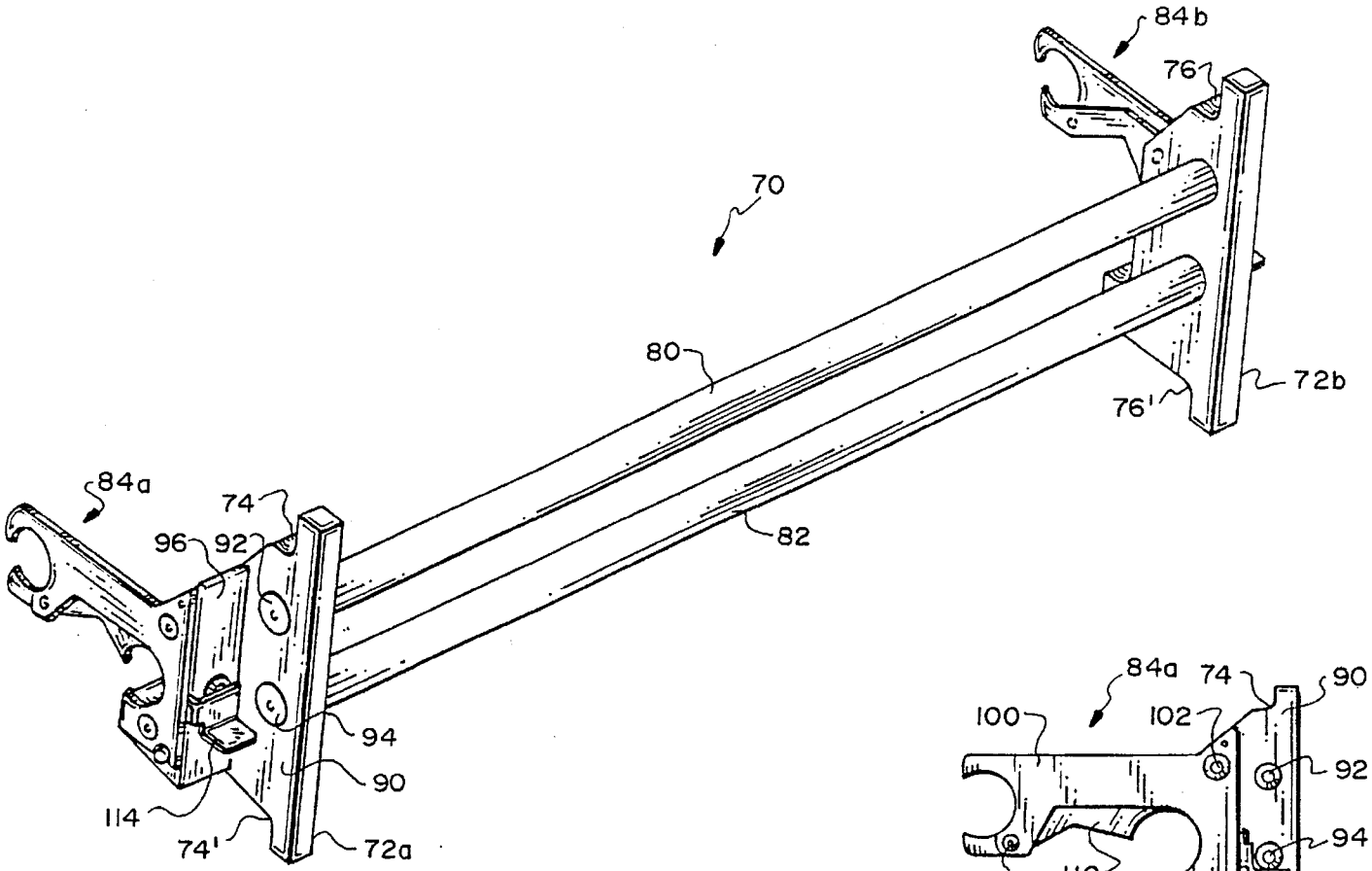
FIG. 5 is an isometric view of a gripping and alignment tool in accordance with the present invention.

Proper alignment of the spools with the camming assemblies is obviously essential for the necessary mating to take place. Such alignment is facilitated by the tool shown in FIGS. 5–8. As best seen in FIG. 5, the tool 70 includes a pair of identical brackets 72*a*, 72*b* shaped so as to form a first pair of alignment grooves 74, 74' associated with bracket 72*a*, and a second pair of alignment grooves 76, 76' associated with bracket 72*b*. A pair of rods 80, 82 extend between brackets 72*a*, 72*b*, serving as frame members that fix the position of the brackets with respect to one another and which may be held by a user. Mounted to each bracket 72*a*, 72*b* are a pair of hinged members forming a double jaw assembly 84*a*, 84*b* that holds an end of each of the supply and uptake spools.

Figure 6:
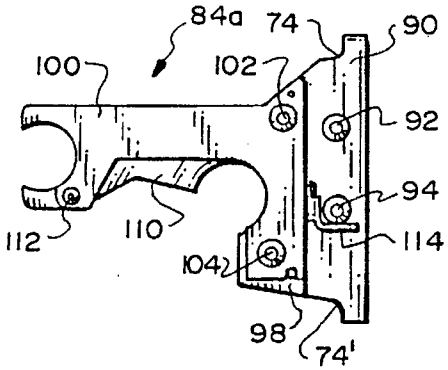
FIG. 6 is an elevational view of the tool shown in FIG. 5.

The construction of the jaw assemblies may be understood with reference to FIGS. 5 and 6, the latter representatively depicting the assembly 84*a* in end view. Assembly 84*a* includes a support 90 to which the individual jaw members and bracket 72*a* are affixed. An inner wall of support 90 is secured to bracket 72*a* by a pair of fasteners 92, 94. Extending outwardly at a right angle from the inner wall is a shoulder that forms a floor 96, an inside corner with the wall and an outside corner with an outer wall 98. A stationary jaw member 100 is affixed to outer wall 98 by a pair of fasteners 102, 104. A movable jaw member 110 is hingedly affixed to stationary jaw member 100 by a pivot 112. Movable jaw member 110 terminates in a tab 114, which protrudes through a slot in floor 96. As may be seen from the figures, the jaw members are shaped such that movement of tab 114 in the direction of groove 74 opens the mouths formed by the curved portions of members 100, 110. Retraction of tab 114 toward groove 74' closes the mouths, which are shaped to prevent a rod fitting snugly therein from escaping. The diameter of each closed mouth matches that of a spool 10 (or, preferably, that of engagement member 14 and gear 16 shown in FIG. 1).

Figure 7:
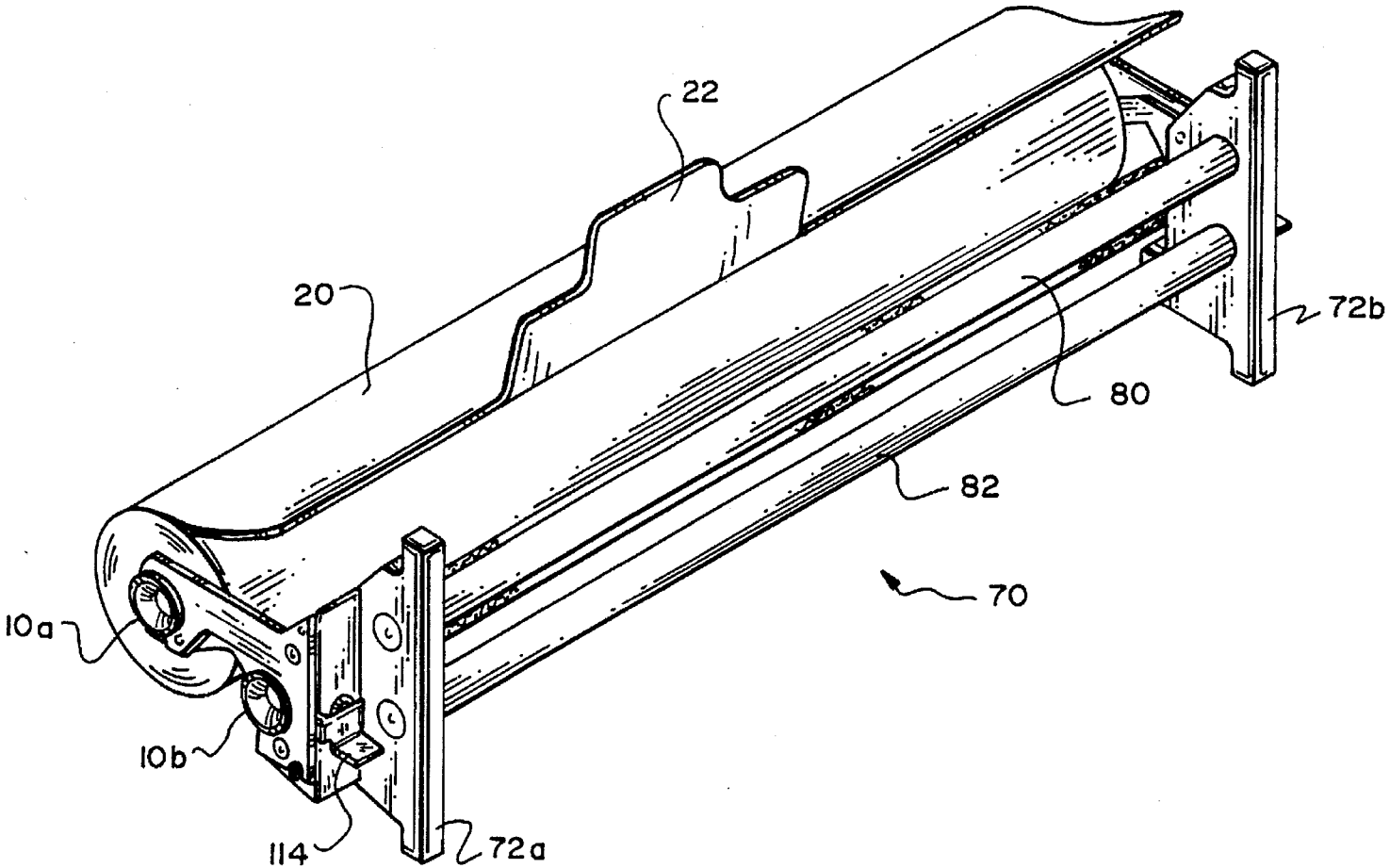
FIG. 7 is another isometric view of the gripping and alignment tool shown in FIG. 5 with supply and uptake spools held therein.
Figure 8:
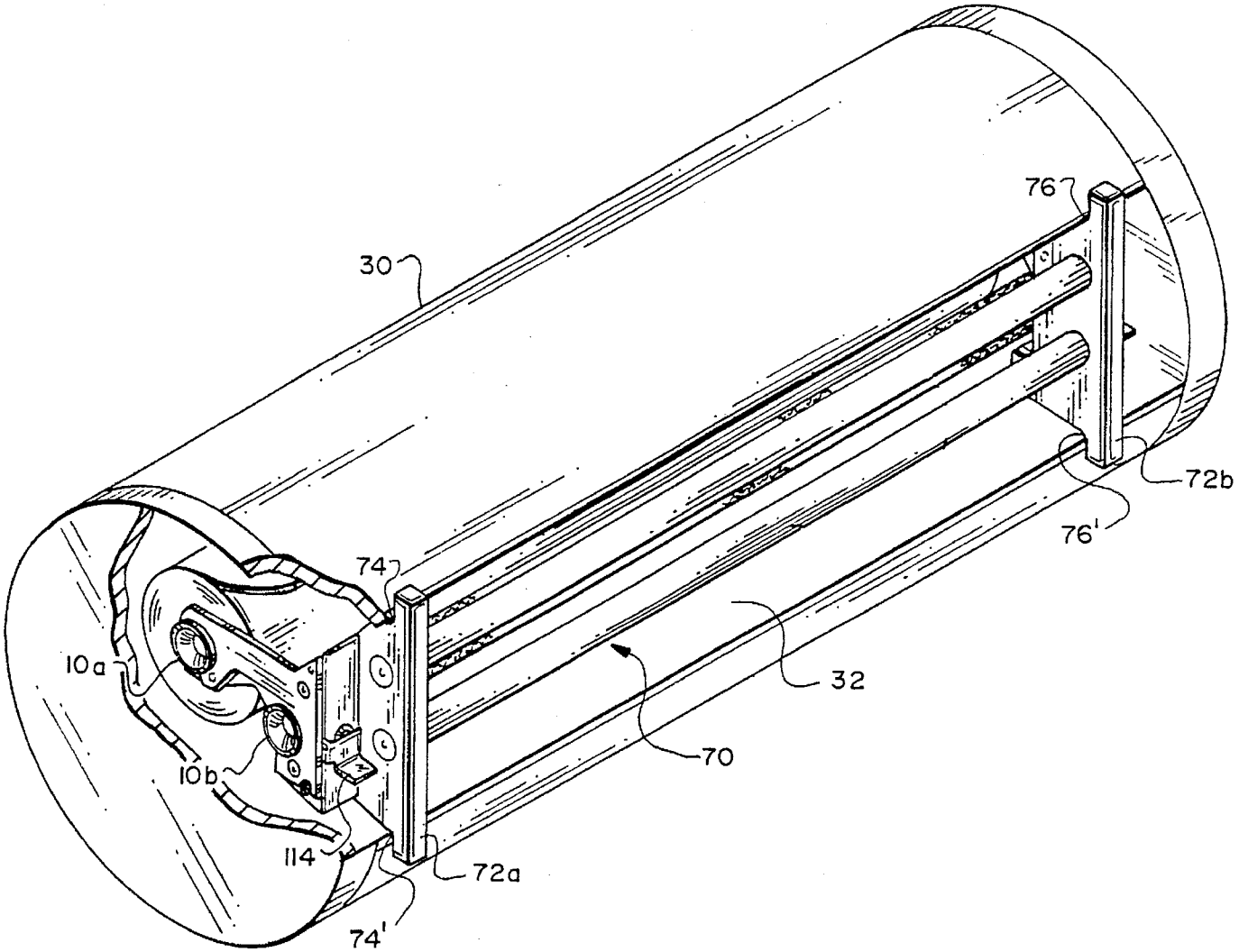
FIG. 8 illustrates the manner in which the tool shown in FIGS. 5–7 is used to introduce plate material into the interior of a plate cylinder.

Thus, with the tabs on each jaw assembly **84*a*, 84*b* drawn toward alignment grooves 74, 76, a pair of spools can be loaded in the open mouths. The tabs are drawn so as to close the months formed by the jaw members and thereby grip the spools. Particularly if plate material 20 spans the full length of spool 10, the jaw assemblies are configured to snugly accept engagement member 14 and gear 16. This is illustrated in FIG. 7, where supply spool 10*a* is held in the terminal jaw and uptake spool 10*b*** in the inner jaw.

The relative orientations of the jaw mouths and the alignment grooves, as well as the spacings therebetween, are selected to allow convenient and reliable positioning of gripped spools within the cylinder 30. In particular, the distance between the center points of the jaw mouths precisely matches that between sleeves **40*a*, 40*b* (see FIGS. 3A and 3B), and the distance between pairs of alignment grooves precisely matches the width of opening 32. Employing the tool 70, the user secures supply and uptake spools within the jaw assemblies as described above, and, holding frame members 80, 82, introduces the spools into the hollow of cylinder 32 until the edges of opening 32 are received in the four alignment grooves 74, 74', 76, 76'. With the outwardly curved ends of the alignment grooves braced against the exterior of cylinder 30, the user is assured that the sleeves 40*a*, 40*b* are precisely aligned with spool engagement members 14, and that gears 16 are aligned with complementary gears within cylinder 30. The user then rotates tab 50 to engage the spools, and slides tab 114 so as to release the spools from tool 70**, which may then be withdrawn.

It will therefore be seen that we have developed a reliable and convenient mechanism for dispensing and receiving material that wraps around a cylinder, and which is especially suited to lithographic printing systems. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Apparatus for accepting and winding lithographic plate material around a cylinder adapted for rotation about a longitudinal axis, the apparatus comprising:

a. a hollow cylinder having an interior and an axial opening thereto, first engagement means within the interior for selectably engaging a supply spool to the cylinder and second engagement means for selectably engaging an uptake spool to the cylinder, the first and second engagement means being in fixed alignment with one another and being disposed within the cylinder so as to define an unobstructed winding path extending around the cylinder from the supply spool to the uptake spool;

b. means for rotating the cylinder;

c. means for selectably coupling rotary power to the second engagement means; and d. a tool for loading supply and uptake spools into the interior of the cylinder, the tool comprising:

i. first gripping means for releasably gripping a supply spool;

ii. second gripping means for releasably gripping an uptake spool;

iii. alignment means for aligning the first gripping means with the first engagement means and the second gripping means with the second engagement means, the alignment and gripping means being removable from the cylinder following release and engagement of spools to the first and second engagement means.

2. The apparatus of claim 1 further comprising:

a. a supply spool for dispensing lithographic plate material in web form;

b. an uptake spool comprising means for engaging a free edge of the plate material contained on the supply spool.

3. The apparatus of claim 1 wherein the first and second engagement means are selectably movable longitudinally within the cylinder.

4. The apparatus of claim 3 further comprising a cam for longitudinally moving the first and second engagement means.

5. A tool for loading lithographic plate material into a hollow cylinder having an interior and an axial opening thereto, first engagement means within the interior for selectably engaging a supply spool to the cylinder and second engagement means for selectably engaging an uptake spool to the cylinder, the first and second engagement means being laterally fixed with respect to one another, the tool comprising:

a. first gripping means for releasably gripping a supply spool;

b. second gripping means for releasably gripping an uptake spool;

c. alignment means for aligning the first gripping means with the first engagement means and the second gripping means with the second engagement means, the alignment and gripping means being removable from the cylinder following release and engagement of spools to the first and second engagement means.

6. The tool of claim 5 wherein the axial opening to the cylinder comprises a pair of oppositely disposed edges, the alignment means comprising a pair of brackets each interfitting with opposite edges of the axial opening and being rigidly affixed to the first and second gripping means.

7. The tool of claim 6 wherein the brackets comprise grooves for receiving opposite edges of the axial opening.

8. The tool of claim 7 wherein the grooves each have an identical length and terminate in a stop member which, when the groove has fully received an edge of the axial opening, rests against the cylinder, the length being selected to ensure alignment of the first gripping means with the first engagement means and the second gripping means with the second engagement means when all stop members rest against the cylinder.

9. The tool of claim 6 further comprising at least one frame member extending between the brackets and fixing the position of the first and second gripping means with respect to one another.

10. Apparatus for accepting and winding lithographic plate material around a cylinder adapted for rotation about a longitudinal axis, in combination with a lithographic printing press, the combination comprising:

a. a hollow cylinder having an interior and an axial opening thereto, first engagement means within the interior for selectably engaging a supply spool to the cylinder and second engagement means for selectably engaging an uptake spool to the cylinder, the first and second engagement means being in fixed alignment with one another and being disposed within the cylinder so as to define an unobstructed winding path extending around the cylinder from the supply spool to the uptake spool;

b. means for rotating the cylinder;

c. means for selectably coupling rotary power to the second engagement means;

d. a tool for loading supply and uptake spools into the interior of the cylinder, the tool comprising:

i. first gripping means for releasably gripping a supply spool;

ii. second gripping means for releasably gripping an uptake spool;

iii. alignment means for aligning the first gripping means with the first engagement means and the second gripping means with the second engagement means, the alignment and gripping means being removable from the cylinder following release and engagement of spools to the first and second engagement means;

e. a supply spool for dispensing lithographic plate material in web form;

f. an uptake spool comprising means for engaging a free edge of the plate material contained on the supply spool; and g. means for imaging plate material extending around the cylinder in response to electronic picture signals encoding an image, the imaging being accomplished by selectively ablating portions of the plate material so as to create a pattern of features corresponding to the image and having different affinities for at least one printing liquid selected from the group consisting of ink and an adhesive fluid for ink.

11. The apparatus of claim 10 further comprising:

a. means for transferring ink to the imaged plate material; and b. means for transferring a recording medium to the inked plate to receive ink in accordance with the pattern of features.

* * * * *